United States Patent [19]

Mierzejewski

[11] 3,963,244

[45] June 15, 1976

[54] PENDULUM PUTTER

[76] Inventor: Henry Mierzejewski, 51 Broadview Terrace, Pittsfield, Mass. 01201

[22] Filed: Feb. 27, 1975

[21] Appl. No.: 553,646

[52] U.S. Cl. ..... 273/162 R; 273/192

[51] Int. Cl.[2] ..... A63B 53/00

[58] Field of Search ..... 273/67 R, 77 R, 80 R, 273/81 R, 81 C, 81.3, 83, 87.2, 87.4, 129, 162 R, 167 R, 183 D, 192, 193 R, 194 R; 294/118; 403/164, 165

[56] References Cited

UNITED STATES PATENTS

| | | | |
|---|---|---|---|
| 168,323 | 10/1875 | Crandall | 273/77 R X |
| 1,618,638 | 2/1927 | Coles | 273/77 R |
| 2,445,718 | 7/1948 | Sternberg et al. | 273/193 B X |
| 2,493,886 | 1/1950 | Lutolf | 403/165 X |
| 2,738,155 | 3/1956 | McCormick | 403/164 X |
| 2,766,473 | 10/1956 | Thackara | 403/165 X |
| 2,776,836 | 1/1957 | Zadina | 273/192 |
| 2,824,742 | 2/1958 | Fortin | 273/192 |
| 3,378,262 | 4/1968 | Haley | 273/194 R X |
| 3,466,046 | 9/1969 | McTeigue | 273/194 X |
| 3,655,226 | 4/1972 | Cowan | 403/165 |

*Primary Examiner*—Richard J. Apley
*Attorney, Agent, or Firm*—Clarence A. O'Brien; Harvey B. Jacobson

[57] ABSTRACT

A pair of first and second generally straight and upstanding shaft members are provided and disposed in side-by-side horizontally spaced apart relation. The lower end of one of the shaft members includes a putter head having a ball striking surface facing in a horizontal direction at substantially right angles relative to a line extending between the vertical mid-portions of the shaft members. The lower end of the other shaft member includes a foot member which projects slightly below the lower portion of the putter head and is provided for engagement with a horizontal support surface. The shaft members include horizontally laterally outwardly projecting shank and sleeve portions removably telescopingly and rotatably engaged with each other for oscillation of the putter head equipped shaft member relative to the other shaft member.

7 Claims, 4 Drawing Figures

PENDULUM PUTTER

BACKGROUND OF THE INVENTION

Various forms of pendulum-type putters have been heretofore designed. However, these previous pendulum putters have been constructed in various manners which do not afford the user a maximum chance of developing substantial accuracy when putting.

Examples of previously patented putters of the pendulum type are disclosed in U.S. Pat. Nos. 168,323, 1,618,638, 1,739,468, 3,170,690, 3,378,262 and 3,466,046.

BRIEF DESCRIPTION OF THE INVENTION

The pendulum putter of the instant invention has been designed in a manner to afford the user maximum opportunity of developing extreme accuracy when putting. Further, the putter may not only be used on a golf course, but may also be used in miniature form when playing a table game of miniature golf or the like.

The main object of this invention is to provide a pendulum type putter including a pair of first and second generally straight and upstanding shaft members disposed in side-by-side horizontally spaced apart relation and having their vertical mid-portions rotatably joined for oscillation of one of the shaft members relative to the other about a horizontal axis extending between the shaft members, and with the lower end of the one shaft member provided with a putter head and the lower end of the other shaft member provided with a ground-engageable foot.

Another object of this invention is to provide a pendulum putter in accordance with the preceding object and including structural features thereof enabling even the novice golfer to obtain relatively high putting expertise.

A further important object of this invention is to provide a pendulum putter in accordance with the preceding objects and constructed in a manner whereby the side-by-side upstanding shaft members may be readily disengaged from each other for storage and ease of transport in a compact state.

A final object of this invention to be specifically enumerated herein is to provide a pendulum putter which will conform to conventional forms of manufacture, be of simple construction and easy to use so as to provide a device that will be economically feasible, long lasting and relatively trouble free in operation.

These together with other objects and advantages which will become subsequently apparent reside in the details of construction and operation as more fully hereinafter described and claimed, reference being had to the accompanying drawings forming a part hereof, wherein like numerals refer to like parts throughout.

DETAILED DESCRIPTION OF THE INVENTION

Figure 1:
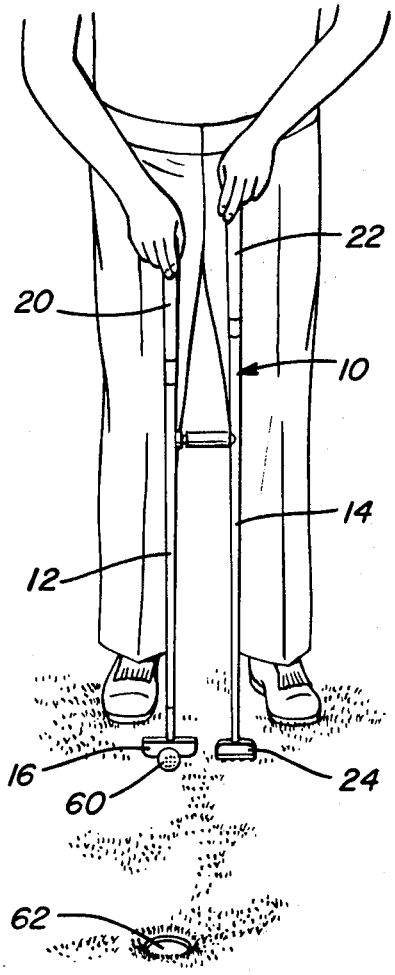
FIG. 1 is an elevational view of the pendulum putter illustrating the manner in which it may be used to putt a golf ball toward a hole cup.
Figure 3:
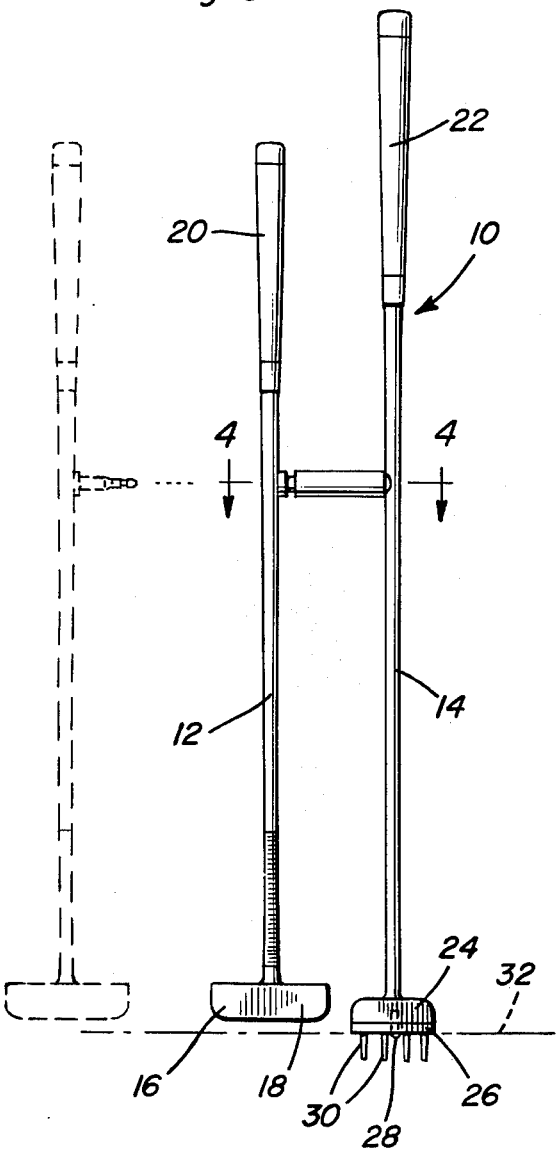
FIG. 3 is an enlarged front elevational view of the pendulum putter and with an alternate position of the head-equipped shaft member thereof disengaged from the other shaft member illustrated in phantom lines.

Referring now more specifically to the drawings, the numeral 10 generally designates the pendulum putter of the instant invention.

The putter includes a pair of first and second generally straight upstanding shaft members 12 and 14 disposed in side-by-side horizontally spaced apart relation. The lower end of the shaft member 12 is equipped with an enlarged putter head 16 and the head 16 includes a horizontally and forwardly facing ball-striking surface 18.

The upper end portions of the shaft members 12 and 14 include handgrip portions 20 and 22 and the lower end of the shaft member 14 includes an enlarged base 24 to which an enlarged foot 26 is secured by means of a plurality of fasteners 28. The fasteners 28 are removable and thus various forms of foot members may be secured to the base 24. The foot 26 includes a plurality of horizontally spaced apart depending ground-engaging tines 30 whereby the lower end of the shaft member 14 may be securely engaged with the ground or other playing surface 32 when desired.

The shaft member 12 is provided with a horizontally outwardly projecting shank portion 34 and the shaft portion 14 includes a horizontally outwardly projecting sleeve body 36. The shank portion 34 includes a diametrically reduced outer end portion 38 which terminates in a frusto-conical point 40 and the diametrically reduced portion 38 includes a circumferential outwardly opening groove 42 in which a snap ring 44 is engaged.

The shank portion 34 is secured to the shaft member 12 in any convenient manner such as by welding 46 and the sleeve body 36 has one end portion secured to the shaft member 14 in a similar manner as by welding 48.

The outer end of the sleeve body 36 defines an endwise outwardly opening bore 50 including a diametrically reduced inner end portion 52 and the diametrically reduced inner end portion 52 includes a circumferential inwardly opening groove 54 in which the snap ring 44 is removably seatable.

It is to be understood that the shank portion 34 is removably engaged with the sleeve body 36 and releasably retained in engagement with the latter by means of the snap ring 44. The diameter of the bore 50 is only slightly larger than the diameter of the shank portion 34 and the shank portion 34 defines a conical shoulder 56 which connects the large and small diameter end portions of the shank portion 34. The conical tip 40 and shoulder 56 facilitate telescopic engagement of the shank portion 34 with the sleeve body 36 and it is to be understood that any suitable form of lubricant may be utilized sparingly between the relatively rotatable surfaces of the shank portion 34 and sleeve body 36.

Figure 4:
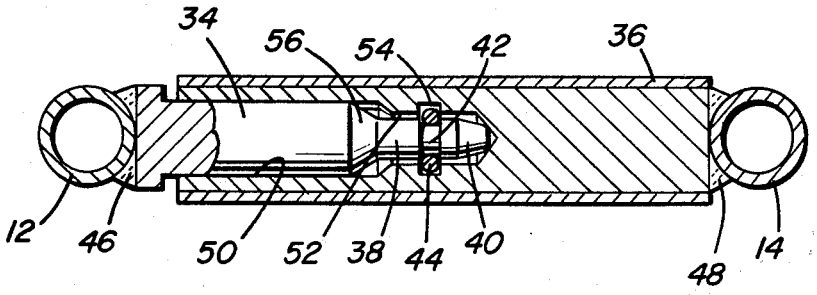
FIG. 4 is an enlarged fragmentary horizontal sectional view taken substantially upon the plane indicated by the section line 4—4 of FIG. 3.

In operation, the shaft members 12 and 14 may be stored and transported from one location to another in disengagement with each other. However, when it is desired to utilize the putter 10, the shank portion 34 is telescoped into the sleeve body 36 in the manner illustrated in FIG. 4 of the drawings whereby the shaft member 12 will be oscillatably supported from the shaft member 14.

Figure 2:
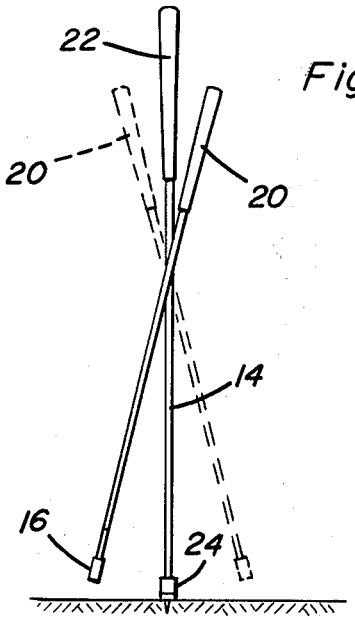
FIG. 2 is a side elevational view of the assemblage illustrated in FIG. 1 as seen from the left side thereof and with an alternate position of the head-equipped shaft member illustrated in phantom lines.

When attempting a putting shot, the putter 10 may be positioned behind the ball 60 in the manner illustrated in FIG. 1 of the drawings and the user of the putter 10 may stand behind the latter. Then, with one of the user's hands resting on the handgrip portion 22 in order to stationarily support the shaft member 14 from the ground 32, the user's other hand is engaged with the handgrip portion 20 and the handgrip portion 20 may be oscillated back and forth to address the ball 60. Then, when the user is confident that the putter 10 is properly aligned with the ball 60 and the cup 62, movement of the handgrip portion 20 rearwardly from the solid line position thereof illustrated in FIG. 2 of the drawing to the phantom line position illustrated in FIG. 2 will cause the head 16 to strike the ball 60 and to drive the latter directly toward the cup 62.

If the putter 10 is to be utilized on other than a ground surface 32, the foot 26 may be removed and replaced by a foot of different design more suited for use on the particular type of playing surface with which the club 10 is to be used. Also, if the putter 10 is to be utilized in miniature form in connection with a game of miniature golf or the like, a foot of different configuration than the foot 26 will be used.

It will be noted that the height of the shaft member 14 is greater than the height of the shaft member 12. In this manner, the user's hands are vertically spaced apart as well as horizontally spaced apart during use of the putter 10. Further, it will be noted that the axis of oscillation of the shaft member 12 relative to the shaft member 14 is disposed above the vertical center of the shaft member 12. In this manner, a putting stroke may be carried out for short distance putts merely by initially swinging the handgrip portion 20 forwardly and then releasing the handgrip portion 20 so that the forces of gravity will swing the heavier lower end portion of the shaft member 12 forwardly for impacting with the associated golf ball.

The foregoing is considered as illustrative only of the principles of the invention. Further, since numerous modifications and changes will readily occur to those skilled in the art, it is not desired to limit the invention to the exact construction and operation shown and described, and accordingly all suitable modifications and equivalents may be resorted to, falling within the scope of the invention as claimed.

What is claimed as new is as follows:

1. A pendulum putter comprising a pair of first and second generally straight upstanding shaft members disposed in side-by-side horizontally spaced apart relation, the lower end of one said shaft members including a putter head having a ball striking surface facing in a direction at substantially right angles relative to a line extending between vertical mid-portions of said shaft members, the lower end of the other of said shaft members including a foot member projecting slightly below the lowermost portion of said putter head, said vertical mid-portions of said first and second shaft members including horizontally laterally outwardly projecting shank and sleeve portions, respectively, removably telescopingly and rotatably engaged with each other for oscillation of said one shaft member relative to said other shaft member, said shank portion being generally cylindrical and including a diametrically reduced outer end portion, said sleeve portion defining an endwise outwardly opening longitudinal bore including a diametrically reduced inner end portion, said shank portion being rotatably received in said bore and said outer end portion of said shank portion being rotatably received in said diametrically reduced inner end portion of said bore.

2. The combination of claim 1 wherein said first shaft member comprises said one shaft member.

3. The combination of claim 1 wherein said other shaft member is of greater vertical extent than said one shaft member.

4. The combination of claim 1 wherein said foot member is removably supported from the lower end of said other shaft member.

5. The combination of claim 1 wherein the outer terminal end of said outer end position is conical and said shank portion includes a frusto-conical shoulder joining said diametrically reduced outer end portion to the larger diameter portion thereof.

6. The combination of claim 1 wherein said outer end portion includes a circumferential outwardly opening groove, a snap ring seated in said groove, said diametrically reduced inner end portion including an inwardly opening circumferential groove in which said snap ring is removably seated.

7. The combination of claim 1 wherein said shank and sleeve portions are spaced above the longitudinal center of said one shaft member.

* * * * *